US005956064A

United States Patent [19]

Sandberg

[11] Patent Number: 5,956,064

[45] Date of Patent: Sep. 21, 1999

[54] DEVICE FOR ENHANCING TRANSPORT OF PROPER POLARITY TONER IN DIRECT ELECTROSTATIC PRINTING

[75] Inventor: Agneta Sandberg, Göteborg, Sweden

[73] Assignee: Array Printers Publ. AB, Vastra Frolunda, Sweden

[21] Appl. No.: 08/729,349

[22] Filed: Oct. 16, 1996

[51] Int. Cl.[6] ..... B41J 2/385; G03G 9/08

[52] U.S. Cl. ..... 347/158

[58] Field of Search ..... 347/151, 158, 347/55, 149, 152; 399/372, 281, 46

[56] References Cited

U.S. PATENT DOCUMENTS

| | | |
|---|---|---|
| 3,566,786 | 3/1971 | Kaufer et al. . |
| 3,689,935 | 9/1972 | Pressman et al. . |
| 3,779,166 | 12/1973 | Pressman et al. . |
| 4,263,601 | 4/1981 | Nishimura et al. . |
| 4,274,100 | 6/1981 | Pond . |
| 4,353,080 | 10/1982 | Cross . |
| 4,384,296 | 5/1983 | Torpey . |
| 4,386,358 | 5/1983 | Fischbeck . |
| 4,470,056 | 9/1984 | Galetto et al. . |
| 4,478,510 | 10/1984 | Fujii et al. . |
| 4,491,794 | 1/1985 | Daley et al. . |
| 4,491,855 | 1/1985 | Fujii et al. . |
| 4,498,090 | 2/1985 | Honda et al. . |
| 4,511,907 | 4/1985 | Fukuchi . |
| 4,525,708 | 6/1985 | Hareng et al. . |
| 4,525,727 | 6/1985 | Kohashi et al. . |
| 4,571,601 | 2/1986 | Teshima . |
| 4,675,703 | 6/1987 | Fotland . |

(List continued on next page.)

FOREIGN PATENT DOCUMENTS

| | | |
|---|---|---|
| 12 70 856 | 6/1968 | Germany . |
| 26 53 048 | 5/1978 | Germany . |
| 44-26333 | 11/1969 | Japan . |
| 55-55878 | 4/1980 | Japan . |
| 55-84671 | 6/1980 | Japan . |
| 55-87563 | 7/1980 | Japan . |
| 58-044457 | 3/1983 | Japan . |
| 58-155967 | 9/1983 | Japan . |
| 62-13356 | 11/1987 | Japan . |
| 6329795 | 5/1990 | Japan . |
| 04189554 | 8/1992 | Japan . |
| 52-08518 | 8/1993 | Japan . |
| 93331532 | 12/1993 | Japan . |

(List continued on next page.)

OTHER PUBLICATIONS

E. Bassous, et al., "The Fabrication of High Precision Nozzles by the Anisotropic Etching of (100) Silicon", *J. Electrochem. Soc.: Solid–State Science and Technology*, vol. 125, No. 8, Aug. 1978, pp. 1321–1327.

Jerome Johnson, "An Etched Circuit Aperture Array for TonerJet® Printing", IS&T's Tenth International Congress on Advances in Non–Impact Printing Technologies, 1994, pp. 311–313.

"The Best of Both Worlds," Brochure of Toner Jet® by Array Printers, *The Best of Both Worlds*, 1990.

*Primary Examiner*—N. Le
*Assistant Examiner*—L. Anderson
*Attorney, Agent, or Firm*—Knobbe, Martens, Olson & Bear, LLP

[57] ABSTRACT

A direct electrostatic printing device for printing an image onto an image receiving substrate includes a toner carrier having a plurality of charged toner particles thereon. A toner delivery unit conveys the charged toner particles to the toner carrier. The toner delivery unit further includes a voltage source and a transfer member connected to the voltage source. The voltage source produces an electrical potential difference between the transfer member and the toner carrier to cause toner particles having a predetermined charge polarity to be attracted from the transfer member to the toner carrier. A printhead structure has an electric field pattern generated on it which is defined by an image to be printed. The printhead structure selectively controls transport of charged toner particles from the toner carrier onto the image receiving substrate.

10 Claims, 1 Drawing Sheet

U.S. PATENT DOCUMENTS

| | | | |
|---|---|---|---|
| 4,717,926 | 1/1988 | Hotomi . | |
| 4,743,926 | 5/1988 | Schmidlin et al. | 347/55 |
| 4,748,453 | 5/1988 | Lin et al. . | |
| 4,814,796 | 3/1989 | Schmidlin . | |
| 4,831,394 | 5/1989 | Ochiai et al. . | |
| 4,837,071 | 6/1989 | Tagoku et al. . | |
| 4,860,036 | 8/1989 | Schmidlin . | |
| 4,912,489 | 3/1990 | Schmidlin | 347/55 |
| 4,922,242 | 5/1990 | Parker . | |
| 5,028,812 | 7/1991 | Bartky . | |
| 5,036,341 | 7/1991 | Larsson . | |
| 5,038,159 | 8/1991 | Schmidlin et al. . | |
| 5,057,855 | 10/1991 | Damouth . | |
| 5,072,235 | 12/1991 | Slowik et al. . | |
| 5,083,137 | 1/1992 | Badyal et al. . | |
| 5,121,144 | 6/1992 | Larson et al. . | |
| 5,128,695 | 7/1992 | Maeda . | |
| 5,148,595 | 9/1992 | Doggett et al. . | |
| 5,170,185 | 12/1992 | Takemura et al. . | |
| 5,181,050 | 1/1993 | Bibl et al. . | |
| 5,204,696 | 4/1993 | Schmidlin et al. . | |
| 5,204,697 | 4/1993 | Schmidlin . | |
| 5,214,451 | 5/1993 | Schmidlin et al. . | |
| 5,229,794 | 7/1993 | Honman et al. . | |
| 5,237,346 | 8/1993 | Da Costa et al. . | |
| 5,256,246 | 10/1993 | Kitamura . | |
| 5,257,045 | 10/1993 | Bergen et al. . | |
| 5,270,729 | 12/1993 | Stearns . | |
| 5,274,401 | 12/1993 | Doggett et al. . | |
| 5,307,092 | 4/1994 | Larson . | |
| 5,386,225 | 1/1995 | Shibata | 347/55 |
| 5,402,158 | 3/1995 | Larson . | |
| 5,450,115 | 9/1995 | Bergen et al. . | |
| 5,473,352 | 12/1995 | Ishida . | |
| 5,477,246 | 12/1995 | Hirabayashi et al. . | |
| 5,506,666 | 4/1996 | Masuda et al. . | |
| 5,515,084 | 5/1996 | Larson . | |
| 5,617,129 | 4/1997 | Chizuk, Jr. et al. . | |
| 5,625,392 | 4/1997 | Maeda . | |
| 5,640,185 | 6/1997 | Kagayama . | |
| 5,650,809 | 7/1997 | Kitamura . | |
| 5,666,147 | 9/1997 | Larson . | |

FOREIGN PATENT DOCUMENTS

| | | |
|---|---|---|
| 94200563 | 8/1994 | Japan . |
| 9048151 | 2/1997 | Japan . |
| 09118036 | 5/1997 | Japan . |
| 2108432 | 5/1983 | United Kingdom . |
| 9014960 | 12/1990 | WIPO . |
| 9201565 | 2/1992 | WIPO . |

DEVICE FOR ENHANCING TRANSPORT OF PROPER POLARITY TONER IN DIRECT ELECTROSTATIC PRINTING

FIELD OF THE INVENTION

The invention relates to a direct electrostatic printing device in which printing is carried out by selectively conveying charged toner particles from a particle carrier directly onto an image receiving substrate. More specifically, the invention relates to an improvement to prevent undesired deflection of the toner particles conveyed from the particle carrier towards the image receiving substrate.

BACKGROUND OF THE INVENTION

Of the various electrostatic printing techniques, the most familiar and widely utilized is xerography, wherein latent electrostatic images formed on a charge retentive surface, such as a roller, are developed by a toner material to render the images visible, the images being subsequently transferred to plain paper. This process is called an indirect process since the visible image is first formed on an intermediate photoreceptor and then transferred to a paper surface.

Another method of electrostatic printing is one that has come to be known as direct electrostatic printing (DEP). This method differs from the aforementioned xerographic method in that charged toner particles are deposited directly onto an information carrier to form a visible image. In general, this method includes the use of electrostatic fields controlled by addressable electrodes for allowing passage of toner particles through selected apertures in a printhead structure. A separate electrostatic field is provided to attract the toner particles to an image receiving substrate in image configuration.

A particularly advantageous feature of direct electrostatic printing is its simplicity of simultaneous field imaging and toner transport to produce a visible image on the substrate directly from computer generated signals, without the need for those signals to be intermediately converted to another form of energy such as light energy, as is required in electrophotographic printers (e.g., laser printers).

U.S. Pat. No. 5,036,341 granted to Larson discloses a direct electrostatic printing device and a method to produce text and pictures with toner particles on an image receiving substrate directly from computer generated signals. According to that method, a control electrode array is positioned between a back electrode and a rotating particle carrier. An image receiving substrate, such as paper, is then positioned between the back electrode and the control electrode array.

An electrostatic field on the back electrode attracts the toner particles from the surface of the particle carrier to create a particle stream toward the back electrode. The particle stream is modulated by voltage sources which apply an electric potential to selected control electrodes of the control electrode array to create electric fields which permit or restrict transport of toner particles from the particle carrier. In effect, these electric fields open or close selected apertures in the control electrode array to the passage of toner particles by influencing the attractive force from the back electrode to form a modulated stream of charged particles. The charged particles are allowed to pass through selected apertures impinge upon a print receiving substrate interposed in the particle stream to provide line-by-line scan printing to form a visible image.

A drawback of this method is that the charged toner particles which pass through a selected aperture may interact with other electrostatic fields than the intended electrostatic field. This causes toner particles to be deflected from their initial trajectory toward the substrate, and to be displaced from the intended print location thereon. Recent observations indicate that toner deflection can be caused by interaction between transported toner particles and charge accumulations on the substrate side of the control electrode array. In effect, as toner particles are transported through a selected aperture, particles having appropriate charge polarity are attracted by the field from the back electrode and deposited on the substrate to contribute to the formation of a visible image. However, it has been observed that toner may contain a low concentration of particles having a polarity opposite to the intended. Those particles are commonly referred to as wrong sign toner (WST). Since the electric field generated by the back electrode acts to repel WST, the trajectory of WST particles passing through a selected aperture is reversed, whereby WST particles are deposited onto the substrate side of the control electrode array. After sufficient WST particles accumulate on the control electrode array, the electric field produced by them begins to alter the trajectory of right sign toner (RST) toward the print receiving substrate. As a result, transported toner particles are deflected from their initial trajectories due to interaction with accumulated WST charge in the vicinity of the aperture.

A number of different approaches have been proposed to restrict the contamination of the control electrode array. U.S. Pat. No. 4,814,796, granted to Schmidlin, discloses a direct electrostatic printing apparatus including structure for delivering toner particles to a printhead. According to Schmidlin, a DC-biased AC voltage is applied to the toner carrier to excite the toner into a cloud-like state in the neighborhood of the apertures. During printing, the back electrode is electrically biased to a DC potential. Periodically, in the absence of substrate, the back electrode is switched from the DC potential to a biased AC power supply that is 180 ° out of phase with the particle carrier AC, such that toner is caused to oscillate and thereby bombard the control electrode array, causing the toner accumulated on the control electrode array to be dislodged. The Schmidlin method requires a periodical cleaning process that must be implemented after one or several pages for removal of dislodged toner particles.

Another attempt to restrict WST accumulation is disclosed in European Patent Application No. 0494454A2. Toner particles are simultaneously stirred and electrically charged within a container by rotating corona elements arranged in a fluidizing bed. Charged toner particles are thereafter electrically attracted onto a first cylinder and transferred to a photoreceptive image cylinder by a plurality of transfer cylinders. A control cylinder is used to remove opposite sign charged toner from an applicator cylinder. The removed toner is vacuumed off the control cylinder. A drawback with this method is that the electric forces applied by the control cylinder may affect the uniformity of the toner layer thickness on the applicator cylinder.

Hence, in order to reduce toner deflection due to WST charge accumulation on the substrate side of the control electrode array, there is still a need to improve a toner delivery system in which toner particles supplied in the vicinity of the printhead have required polarity.

SUMMARY OF THE INVENTION

The present invention satisfies a need for improved print quality of direct electrostatic printing device by preventing undesired toner deflection due to charge accumulation on a printhead structure.

An electrostatic printing device according to the present invention generally includes a back electrode connected to a back voltage source, a toner delivery unit, a printhead structure positioned between the back electrode and the toner delivery unit, and an image receiving substrate interposed between the back electrode and the printhead structure.

The toner delivery unit includes a toner container, a supplying means such as a supply brush for conveying toner from the toner container to the surface of a transfer sleeve, a metering blade for restricting the toner layer thickness on the transfer sleeve, a voltage source that applies an electric potential difference between the transfer sleeve and a toner carrier to cause toner particle having a required charge polarity to be electrically attracted onto the surface of the toner carrier, a scraper blade for removing excess toner from the toner carrier after print operation, and a toner recycling unit for conveying unused toner back to the toner container.

According to the present invention, toner particles are charged by triboelectrification through frictional contact with other toner particles, through contact with the fibrous material of the supply brush, and through friction against the metering blade. Uniform layer thickness and homogenous particle distribution are obtained on the surface of the transfer sleeve before achieving selection of right sign toner. The transfer sleeve and the toner carrier are preferably rotating cylinders having parallel rotation axes and peripheral surfaces separated by a migration gap. An electric field is applied through the migration gap to collect right sign toner from the transfer sleeve onto the toner carrier. That electric field is chosen to be sufficient to attract toner particles having a charge mass ratio (Q/m) within a predetermined range. Those particles are thereby caused to jump from the transfer sleeve onto the toner carrier to be conveyed to a position adjacent to the printhead structure. Accordingly, the migration gap precludes collection of wrong sign toner on the particle carrier, thereby also preventing accumulation of wrong sign toner onto or in the vicinity of the printhead structure. The toner layer thickness on the surface of the toner carrier is determined by the transfer efficiency and the relative rotation velocity of the toner carrier and the transfer sleeve.

DETAILED DESCRIPTION OF THE PREFERRED EMBODIMENT

Figure 1:
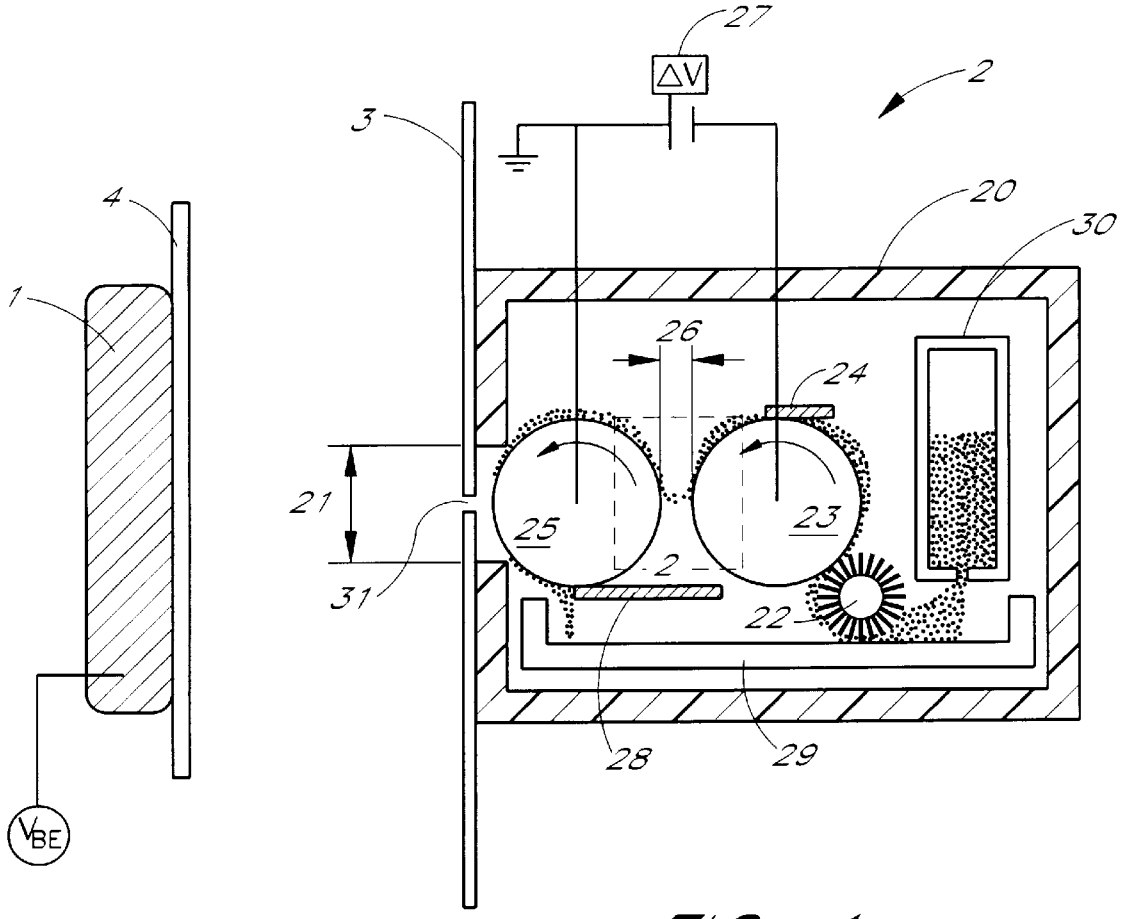
FIG. 1 is a schematic section view of a direct printing device in accordance with the present invention.

FIG. 1 is a schematic section view through a direct electrostatic printing device in accordance to the preferred embodiment of the invention, including:

a back electrode 1 connected to a back voltage source $V_{BE}$; a toner delivery unit 2; a printhead structure 3 positioned between the back electrode 1 and the toner delivery unit 2; and an image receiving substrate 4, interposed between the printhead structure 3 and the back electrode 1.

The toner delivery unit 2 is enclosed in a container 20 having front and back walls (not shown), a pair of side walls, and a bottom wall with an elongated opening 21 extending across the print zone from the front wall to the back wall. The container 20 provides a mounting surface for the printhead structure 3 which extends across and covers over the opening 21. The toner delivery unit 2 includes a toner carrier 25 that conveys toner particles to a print position in the opening 21, such that toner particles brought in print position experience the electrostatic field pattern generated on the printhead structure 3.

Toner particles are supplied from a toner container 30 to the toner carrier 25 through a supplying device 22 and a transfer sleeve 23. The toner carrier 25 is preferably a rotating cylinder whose peripheral surface is spaced from the printhead structure 3 by approximately 60 microns. The transfer sleeve 23 is preferably a rotating cylinder having rotation axis extending parallel to the rotation axis of the toner carrier 25. The transfer sleeve 23 and the toner carrier 25 are brought into electric cooperation with each other. An electric potential difference within the range 1000–2500 V, preferably within the range 1500–2000 V, is produced by a voltage source 27 between the toner carrier 25 and the transfer sleeve 23 across a migration gap 26 having an extension in the order of approximately 500 microns, such that toner particles having a Q/m ratio within a predetermined range are caused to jump from the surface of the transfer sleeve 23 onto the surface of the toner carrier 25. Toner particles so selected are thereby homogeneously distributed on the toner carrier 25 in a smooth toner layer having uniform thickness and charge distribution. The layer thickness uniformity on the toner carrier 25 is obtained without the need of contacting elements, such as doctor blade or the like, which may alter the charge distribution of toner particles through frictional interaction with the toner layer. Since the migration gap 26 precludes the occurrence of WST on the toner carrier surface, and since no contacting element is required on that surface, toner particles conveyed in print position at the opening 21 preserve the appropriate polarity. The absence of WST in the print position ensures that all toner particles allowed to pass through a selected aperture in the printhead structure 3 are attracted by the electric field of the back electrode 1 to contribute to the formation of a visible image on the image receiving substrate 4. Unused toner particles are scraped from the surface of the toner carrier 25 by a scraper blade 28 located between the print position and the migration gap 26. Those unused particles are thereby collected in a toner recycling unit 29 which conveys toner back to the supplying device 22.

Toner particles preferably comprise a nonmagnetic material. Nonmagnetic toner particles are attracted and held to the surface of the transfer sleeve 23 by an electrostatic force created by triboelectrification of the toner particles through frictional interactions against the fibrous material of the supplying device 22 and the surface of the transfer sleeve 23. Toner particles may be triboelectrically charged even through interaction with a metering blade 24 positioned proximate to the transfer sleeve 23.

Alternatively, toner particles may comprise magnetic material and may be attracted to the sleeve surface by a magnet core enclosed within the transfer sleeve 23.

Figure 2:
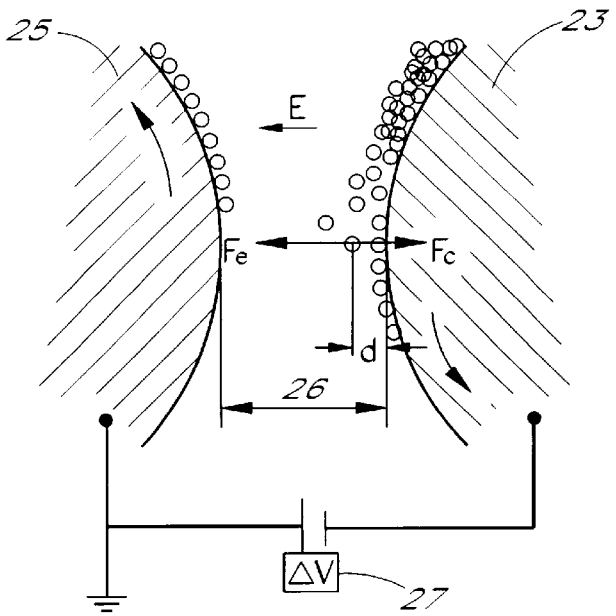
FIG. 2 is a detailed view of the area A of FIG. 1, illustrating the selective transfer of toner particles.

FIG. 2 is an enlargement of the migration gap 26 shown in FIG. 1. The migration gap 26 is dimensioned and the voltage provided by the voltage source 27 is set to select toner particles having a Q/m ratio within a predetermined range. A charged toner particle is held on the transfer sleeve surface a Coulomb retention force $F_c$, which is essentially proportional to $Q^2/d^2$, where d is the distance between the particle and the sleeve surface 23. That force must be overcome by the electrostatic field attraction force $F_e$=QE to allow transfer of the particle through the migration gap 26. The transfer efficiency is determined by the applied electric field strength E and the toner layer thickness on the transfer sleeve 23. The layer thickness on the toner carrier 25 can be restricted by lowering the rotation velocity of the transfer sleeve 23 in relation to the rotation velocity of the toner carrier 25. The voltage source 27 is preferably a DC power supply. Alternatively, the voltage source 27 may be a DC-biased AC power supply that causes toner particles to oscillate between the transfer sleeve 23 and the toner carrier 25. In that case, clusters of toner particles of opposite polarities bounded electrostatically to each other are effectively broken up through collisions against the surface of the toner carrier or the transfer sleeve.

The printhead structure 3 is schematically shown in FIG. 1 and is constructed of a thin, sheet-like, nonrigid material provided with a plurality of apertures 31 arranged therethrough and overlaid with a printed circuit, such that each aperture is surrounded by an individually selectable control electrode. A back voltage source ($V_{BE}$) is connected to the back electrode 1 to attract toner particles from the particle carrier 25, through the apertures 31 in the printhead structure 3, onto the image receiving substrate 4. Control voltage signals defining the image information are applied to the control electrodes to create a pattern of electrical fields which permit or restrict transport of toner particles from the particle carrier 25. These electric fields "open" or "close" the apertures 31 to passage of toner particles by influencing the attractive force from the back electrode 1. Varying the control voltage signals produces a visible image pattern on the image receiving substrate 4 corresponding to the pattern of opened and closed apertures 31. Excess toner particles are thereafter scraped from the toner carrier 25 by a scraper blade 28 arranged in a tangential contact with the surface of the toner carrier 25. The scraper blade 28 thus operates as a cleaner which cleans the surface of the toner carrier 25.

The image receiving substrate 4 is preferably a sheet of plain, untreated paper caused to move across the back electrode 1, but may be any media suited for direct electrostatic printing.

Test Results

In order to establish the efficiency of the present invention, printing has been performed under similar conditions using a conventional toner delivery system and using a toner delivery unit in accordance with the present invention. In the first case, toner particles were conveyed directly from a toner container onto the toner carrier without the use of an intermediate transfer sleeve. In the second case, a transfer sleeve was added to selectively transport toner onto the toner carrier 25 as described above. A migration gap of 500 microns was set up between the transfer sleeve 23 and the toner carrier 25. The toner carrier 25 was grounded and the transfer sleeve 23 was given a potential of 1700 V. In both cases, the weight of toner accumulated on the printhead structure 3 after printing was compared to the weight of toner deposited on the print receiving substrate 4. In the first case, the relation there between was measured to 4%. In the second case, the corresponding relation was reduced to 0.5%.

Although described above in connection with particular embodiments of the present invention, it should be understood the descriptions of the embodiments are illustrative of the invention and are not intended to be limiting. Various modifications and applications may occur to those skilled in the art without departing from the true spirit and scope of the invention as defined in the appended claims.

What is claimed is:

1. A direct electrostatic printing device for printing an image onto an image receiving substrate, said printing device comprising:

a toner having a plurality of charged toner particles thereon;

a transfer member separated from the toner carrier by a migration gap;

a voltage source connected to said transfer member to produce an electrical potential difference between said transfer member and said toner to cause toner particles having a predetermined charge polarity to be attracted across said migration gap from said transfer member to said toner carrier; and a printhead structure on which is generated an electric field pattern defined by an image to be printed, said printhead structure selectively controlling transport of charged toner particles from said toner carrier onto said image receiving substrate.

2. The printing device as defined in claim 1, wherein said transfer member and said toner carrier comprise respective first and second rotating cylindrical sleeves having parallel rotation axes and having peripheral surfaces, said migration gap being the distance between the peripheral surface of the transfer member and the peripheral surface of the toner carrier.

3. The printing device as defined in claim 1, further comprising a metering means, said transfer member cooperating with said metering means to restrict a toner layer thickness on a surface of said transfer member.

4. The printing device as defined in claim 1, further including a cleaner means, said toner carrier cooperating with said cleaning means to remove excess toner particles from said toner carrier after printing.

5. The printing device as defined in claim 1, further comprising a container which encloses said toner delivery unit, said container having front and back walls, a pair of side walls, and a bottom wall, said bottom wall having an elongated opening extending across a print zone, said printhead structure extending across and covering said opening in said container.

6. The printing device as defined in claim 1, wherein said voltage source which produces said electrical potential difference between said toner carrier and said transfer member is DC power supply.

7. The printing device as defined in claim 1, wherein said voltage source which produces said electrical potential difference between said toner carrier and said transfer member is a DC-biased AC power supply.

8. The printing device as defined in claim 2, wherein the toner particles have a density on said peripheral surface of said toner carrier which is determined by a rotational velocity of said transfer member.

9. A direct electrostatic printing device for printing an image onto an image receiving substrate, said printing device comprising:

a toner source;

a toner carrier;

a transfer member which receives toner particles from said toner source, said transfer member being separated from said toner carrier by a migration gap, said toner particles including toner particles of a predetermined charge polarity and toner particles of an opposite charge polarity;

a voltage source connected to provide an electrical voltage potential between said transfer member and said toner carrier, said electrical voltage potential selected to cause toner particles having said predetermined charge polarity to be attracted across said migration gap from said transfer member to said toner carrier without attracting toner particles of said opposite charge polarity; and a printhead structure onto which an image is defined by an electric field pattern, wherein toner particles are transferred from said toner carrier to said image receiving substrate under control of said electric field pattern on said printhead structure.

10. A toner delivery system for a direct electrostatic printing device having a toner source and a toner carrier separated by a migration gap, said toner delivery system comprising:

a transfer member which receives toner particles from said toner source, said toner particles including toner particles of a predetermined charge polarity and toner particles of an opposite charge polarity; and a voltage source connected to provide an electrical voltage potential between said transfer member and said toner carrier, said electrical voltage potential selected to cause toner particles having said predetermined charge polarity to be attracted across said migration gap from said transfer member to said toner carrier without attracting toner particles of said opposite charge polarity.

* * * * *

UNITED STATES PATENT AND TRADEMARK OFFICE

CERTIFICATE OF CORRECTION

PATENT NO. : 5,956,064

DATED : September 21, 1999

INVENTOR(S) : Agneta Sandberg

It is certified that error appears in the above-identified patent and that said Letters Patent is hereby corrected as shown below:

In column 6 at line 1, change "toner having" to --toner carrier having--.

Signed and Sealed this

Twenty-sixth Day of September, 2000

*Attest:*

Q. TODD DICKINSON

*Attesting Officer*

*Director of Patents and Trademarks*